US007452339B2

(12) United States Patent
Mattison

(10) Patent No.: US 7,452,339 B2
(45) Date of Patent: Nov. 18, 2008

(54) PRESSURE POINT THERAPEUTIC DEVICE

(75) Inventor: Philip H. Mattison, Forest Lake, MN (US)

(73) Assignee: Core Products International Inc., Osceola, WI (US)

( * ) Notice: Subject to any disclaimer, the term of this patent is extended or adjusted under 35 U.S.C. 154(b) by 0 days.

(21) Appl. No.: 11/114,428

(22) Filed: Apr. 25, 2005

(65) Prior Publication Data

US 2005/0251069 A1 Nov. 10, 2005

Related U.S. Application Data

(60) Provisional application No. 60/564,786, filed on Apr. 23, 2004.

(51) Int. Cl.
*A61H 23/00* (2006.01)

(52) U.S. Cl. ..... 601/15; 601/111

(58) Field of Classification Search ..... 601/11–112, 601/114

See application file for complete search history.

(56) References Cited

U.S. PATENT DOCUMENTS 3,981,032 A 9/1976 Brooks
4,783,866 A 11/1988 Simmons et al. ..... 5/441
5,295,949 A 3/1994 Hathaway ..... 602/18
5,481,771 A 1/1996 Burk, IV ..... 5/636
5,545,456 A * 8/1996 Suida ..... 428/76
6,007,501 A * 12/1999 Cabados et al. ..... 601/15
6,022,376 A * 2/2000 Assell et al. ..... 623/17.16
6,024,762 A * 2/2000 Gray ..... 607/109
6,681,427 B2 * 1/2004 Anderson et al. ..... 5/713
2002/0052566 A1 * 5/2002 Sequeira ..... 601/112
2003/0109910 A1 * 6/2003 Lachenbruch et al. ..... 607/108

* cited by examiner

*Primary Examiner*—Michael A. Brown
(74) *Attorney, Agent, or Firm*—Nawrocki, Rooney & Sivertson, P.A.

(57) ABSTRACT

A therapeutic article is provided which includes an enclosure containing at least a single structure for overlaying a pressure point, and a viscous fluid substantially surrounding the at least a single structure. The at least a single structure is free to be selectively positionable within the viscous fluid, and along a length and width of the elongate enclosure. The viscous fluid is suited for selectively heating or chilling in furtherance of therapy enhancement. The article is further adapted for use as a wrap structure for affixation about an body portion for receipt of therapy.

40 Claims, 3 Drawing Sheets

26
22a
22b
18
$D_{MAX}$
10
20
30
16
24
28

PRESSURE POINT THERAPEUTIC DEVICE

This is a regular application filed under 35 U.S.C. §111(a) claiming priority under 35 U.S.C. §119(e)(1), of provisional application Ser. No. 60/564,786, having a filing date of Apr. 23, 2004.

TECHNICAL FIELD

The present invention generally relates to self-help tension relief therapy, more particularly, to a hot/cold therapeutic muscle tension relief device having at least a single pressure point stimulator.

BACKGROUND OF THE INVENTION

Musculoskeletal pain intensity runs the gamut from distracting to disabling. In as much as there exists a variety of traditional and non-traditional treatment practitioners, self-help is a powerful, increasingly necessary option.

In addition to traditional hot packs and ice packs, a variety of functionally specific therapeutic wraps, garments, pads, pillows, mattresses, etc. have been designed, patented, and commercialized. Heretofore known therapy articles tend to emphasize a specific aspect of therapy, e.g., heating, chilling, aroma, massage, pressure point, etc., and feature a variety of critical elements, e.g., high heat capacity fruits/seeds (e.g., flax seed), gels, knobbed rollers, balls, wheels, structured foam, e.g., egg crate, space age memory foam, etc., as well as combinations of one or more such features.

A particularly "busy" or crowded therapy area is that associated with head and neck pain. For example, a variety of cervical/occipital pillows or wraps, U.S. Pat. No. 6,024,762 (Gray), U.S. Pat. No. 5,481,771 (Burk, IV), U.S. Pat. No. 5,295,949 (Hathaway), U.S. Pat. No. 4,783,866 (Simmons et al.), and U.S. Pat. No. 3,981,032 (Brooks), include rigidly joined balls substantially fixed in a structured cold pack; paired hemispherical projections adjacent a convex pillow portion; a structure adapted to receive one of several functionally diverse inserts; an insertable occipital cold pack; and, vibrating ridged surfaces in a heating pad, respectively.

In light of the current state of the art in self-help tension relief therapy, there remains a need to provide an article which can be repeatedly heated or chilled characterized by one or more pressure point stimulators having an unencumbered range of motion within an enclosure or the like for the article. It is perceived as being further advantageous to provide a general therapeutic article or device which may be readily engaged, and even affirmatively applied, to a variety of body portions for which therapy is sought.

SUMMARY OF THE INVENTION

A therapeutic article is provided which includes an enclosure containing at least a single structure for overlaying a pressure point, and a viscous fluid substantially surrounding the at least a single structure. The at least a single structure is free to be selectively positionable within the viscous fluid, and along a length and width of the elongate enclosure. The viscous fluid is suited for selectively heating or chilling in furtherance of therapy enhancement. The article is further adapted for use as a wrap structure for affixation about an body portion for receipt of therapy. More specific features and advantages obtained in view of those features will become apparent with reference to the drawing figures and DETAILED DESCRIPTION OF THE INVENTION.

DETAILED DESCRIPTION OF THE INVENTION

Figure 1:
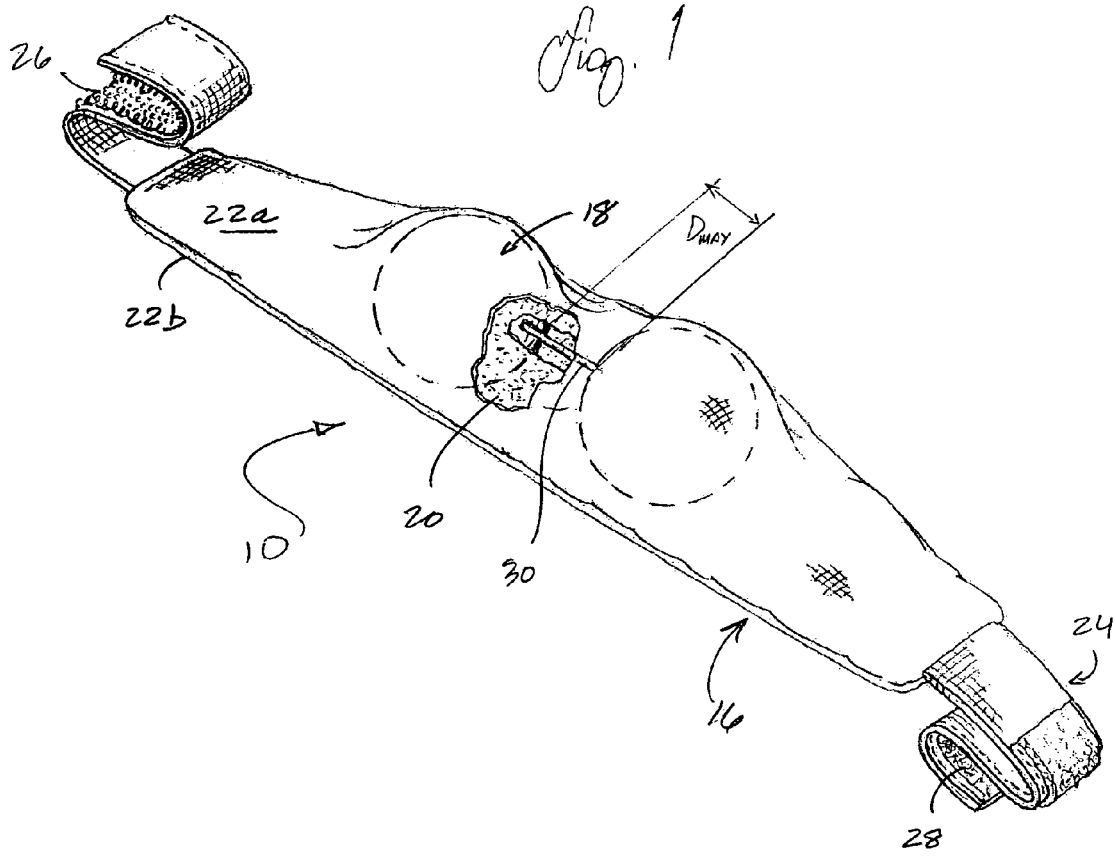
FIG. 1 is a perspective view of a preferred embodiment of the therapeutic article of the subject invention, a portion of a surface thereof broken away to shown underlaying detail.

The therapeutic article or device 10 of the subject invention, more particularly a preferred embodiment thereof, is generally shown in FIG. 1. An alternate configuration for the pressure point structure of the subject invention is illustrated in the cross section of FIG. 2, with the structure thereof incorporated in a pillow-like structure, plan view, of FIG. 3. It is to be understood, as will be subsequently discussed, that alternate configurations for the article, as well as additional features therefor, are contemplated. The figures are intended as illustrative, and not intended to be limiting.

Figure 3:
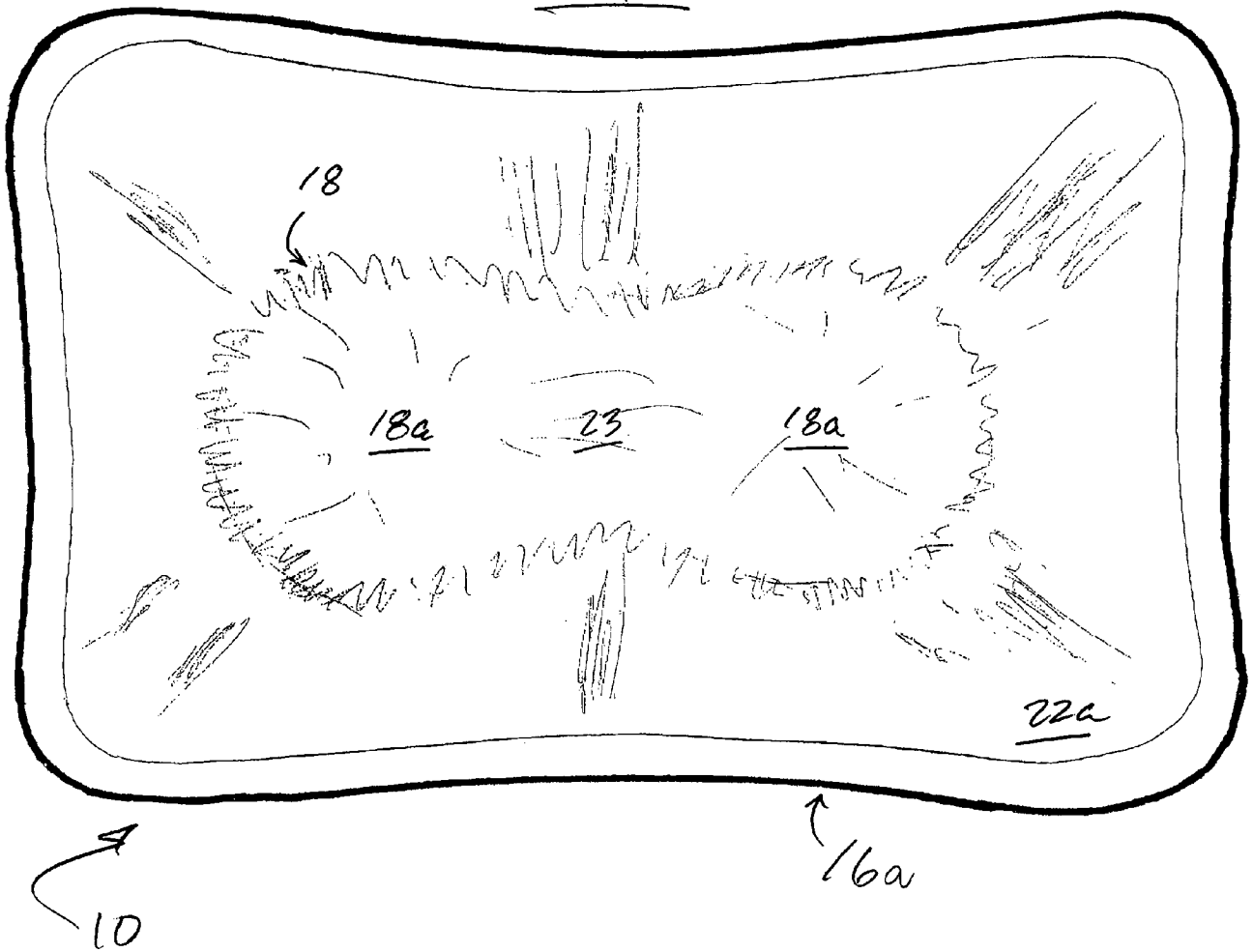

Referring now to FIG. 1, the therapeutic article 10 of the subject invention generally includes an enclosure 16, which may be elongated as shown, or alternately configured, see FIG. 3, containing at least a single structure 18 for overlaying a pressure point of a user of the article. A viscous fluid, or gel/gel-like substance 20, surrounds the one pressure point structure 18, or more as the case may be and as is particularly illustrated, which is longitudinally positionable within the fluid 20, and along or throughout the length, and width of the enclosure 16. Advantageously, the viscous fluid 20 is suited for selective heating of chilling in furtherance of therapy enhancement.

As shown, the enclosure 16, e.g., a pack, includes opposing cover portions 22*a*, 22*b* which are sealiningly united about their periphery so as to retain the items contained therein, namely, the viscous fluid 20 and one or more pressure point structures 18. Either or both opposing ends of the enclosure or pack 16 may be adapted to facilitate transforming the article for application about a select portion of the body for which therapy is desirable. For example, the pack 16 further preferably includes, either as an optional "add-on" feature or an integral feature of the pack as shown, straps 24 extending from opposing ends thereof, the straps adapted for cooperative engagement with one another, or with the pack itself, e.g., each strap may be equipped, as shown, with hooks 26 or loops 28 of a hook and loop fastening system. Alternately, a single strap may extend from the pack for reversible affixation/anchoring to a portion of the pack opposite of the strap. As should be readily appreciated, means for affixing the article of the subject invention about a portion of the body is not intended to be limiting.

The pack 16 is preferably, and advantageously "filled" with the viscous fluid, or gel/gel-like substance 20 which is suited for selective heating or chilling, as for example in a microwave oven or freezer, respectively. Notionally, the "fluid" character is such that there is no "sloshing" of it within the pack, it is however readily displaceable by hand, i.e., by hand manipulation of the pack, or the one or more pressure point structures as will be subsequently discussed, somewhat along the lines of a filled pastry bag. Among other things, such "filling" assures a contoured comfort fit about or at the therapy site.

Although a variety of viscous fluids/substances exhibiting the aforementioned characteristics are known, heretofore known compositions comprising bentonite and glycol are functionally and economically desirable. As to the quantity of the viscous fluid present within the enclosure, it is critical only to provide a sufficient amount to achieve the sought after heating/chilling on the one hand, and permit selective manipulation/positioning of the one or more pressure point structures within the fluid/pack boundary on the other hand.

Figure 2:
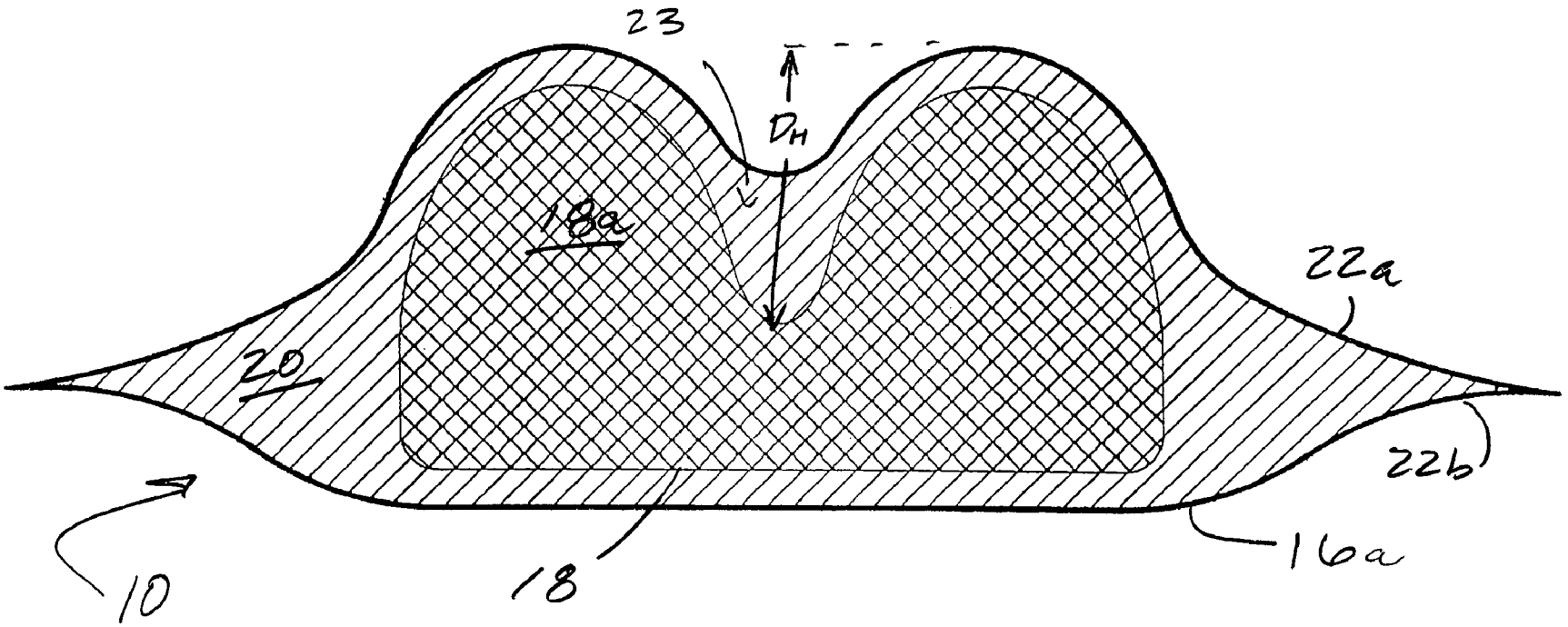
FIG. 2 illustrates, in sectional view, an alternate configuration for the pressure point structure of the subject invention; and, FIG. 3 illustrates, in plan view, the alternate pressure point structure of FIG. 2 in the context of a an alternate pack or enclosure.

One or more pressure point structures 18 are advantageously provided within the pack 16, and essentially within the viscous fluid 20, preferably, but not necessarily, a united pair of structures, as shown in FIG. 1 or FIG. 2. The structure 18 or each structure, e.g., a solid rubber ball, is intended to overlay one or more pressure points upon body engagement with the article, whether such engagement is by "wrapping," or by supporting the afflicted area, i.e., a pillow-like use.

Preferably, but not necessarily, the structure 18 is spherical, substantially spherical (i.e., spheroidal), hemispherical, etc., more generally, the structure has a non-linear cross section, or, has at least a portion satisfying such description, for engagement with a portion of the body. Furthermore, it is advantageous that the structure 18 be semi-rigid, i.e., minimally yielding to hand grip pressure, more particularly, there is advantageously insignificant structure shape deformation under finger/hand grip pressure. Although not shown, the structures may include surface features, that is to say that the surface may be non-smooth. Preferably, e.g., in the case of a spherical structural configuration for application in the occipital region of the skull, the structures are dimensioned so as to have a diameter of about between 1.5 and 2.5 inches, however, this not need be the case.

With reference now to FIGS. 2 & 3, there is shown an alternate configuration for the pressure point structure 18 of the subject invention, more particularly, paired, spaced apart protuberances 18*a* having a common origin, e.g., a common base 19 (FIG. 2), in the context of an alternate pack or enclosure 16*a* (FIG. 3). As to pack 16*a*, it includes the heretofore described viscous fluid 20, sealed therein such that the pressure point structure or element 18 is essentially "swimming" within the enclosure 16*a*.

As shown in the cross section of FIG. 2, the subject pressure point structure 18 is delimited by a pair of "peaks" 18*a* separated by a "valley" 23. While a representative structure plan view is illustrated in FIG. 3, alternate arrangements supporting the cross-section, or substantial cross section of FIG. 2, are possible, contemplated, and advantageous. For example, in plan view, the "footprint" of the structure 18 (i.e., the base 19) may be rectangular, square, hour-glass shaped, etc. As to the cross-section, it is to be understood that the peaks 18*a*, although shown as being rounded (i.e., hemispherical, spheroidal, etc.), may have other profiles, and further, the relationship between the peaks 18*a* and valley 23, e.g., $D_H$, is not intended to be limiting, other dimensional relationships, interrelationships and configurations among and relating the peaks being contemplated and within the scope of the subject invention.

A further advantageous, non-limiting feature of the structure is an ability to be suitably heated/chilled. Although the primary contribution of therapeutic heating/chilling is borne of the viscous fluid, the structures likewise are intended to contribute to or supplement such effect. Be that as it may, it is most certainly within the scope of the invention that the structures be "neutral" with respect to heating/chilling, and thus functions a local intermediary with respect to the application of heat/cold to an afflicted body part, more particularly, the pressure point(s).

As previously noted, in-as-much-as a single pressure point structure may be provided within the pack, it is likewise with the scope of the subject invention that the pack be substantially filled with structures heretofore described. In the context of the preferred embodiment, a pair of structures are provided, more particularly, linked structures. The structures 18 are preferably joined via a non-rigid connection or linkage 30, i.e., tether, e.g., by a filament, cord, etc., although a rigid linkage, i.e., member, is likewise intended to be within the scope of the subject invention, see e.g., FIG. 2. Functionally, the non-rigid linkage assures a not-to-exceed spacing $D_{max}$ for the pair of structures (i.e., two or more structures), while permitting a freedom of motion, one from the other, in the context of a tailored or contoured engagement with a problem body area.

This invention disclosure provides preferred therapy device and article configurations, and defines preferred relationships and interrelationships between structures of the configuration(s). There are other variations of this invention which will become obvious to those skilled in the art. It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claim.

What is claimed is:

1. A therapeutic device comprising a gel filled enclosure, and a single non-rigidly linked pair of pressure point structures housed therein, said single non-rigidly linked pair of pressure point structures being selectively positionable within a perimeter of said gel filled enclosure, pressure point structures of said single non-rigidly linked pair of pressure point structures being selectively arrangable one with respect to the other up to a pre-select not-to-exceed spacing delimited by a non-rigid linkage therebetween, wherein said non-rigid linkage comprises a cord.

2. The therapeutic device of claim 1 wherein said pressure point structures of said single non-rigidly linked pair of pressure point structures comprise semi-rigid elements.

3. The therapeutic device of claim 1 wherein said pressure point structures of said single non-rigidly linked pair of pressure point structures have a non-linear cross-sectional portion.

4. The therapeutic device of claim 1 wherein said pressure point structures of said single non-rigidly linked pair of pressure point structures comprise spherical elements.

5. The therapeutic device of claim 1 wherein said pressure point structures of said single non-rigidly linked pair of pressure point structures comprise spherical elements having a diameter of between about 1.5 and 2.5 inches.

6. The therapeutic device of claim 1 wherein said non-rigid linkage comprises a filament.

7. The therapeutic device of claim 1 wherein said perimeter of said gel filled enclosure delimits a single volume.

8. The therapeutic device of claim 1 wherein gel of said gel filled enclosure is capable of repetitive heating/chilling in furtherance of enhancing therapeutic efficacy.

9. The therapeutic device of claim 1 wherein said pressure point structures of said single non-rigidly linked pair of pressure point structures comprise semi-rigid spherical elements.

10. The therapeutic device of claim 9 wherein said non-rigid linkage comprises a filament.

11. The therapeutic device of claim 10 wherein said perimeter of said gel filled enclosure delimits a single volume.

12. The therapeutic device of claim 11 wherein gel of said gel filled enclosure is capable of repetitive heating/chilling in furtherance of enhancing therapeutic efficacy.

13. A therapeutic device comprising a gel filled enclosure including at least a single strap extending from an end thereof to facilitate affixing the device to a body part, and a single non-rigidly linked pair of pressure point structures housed therein, said single non-rigidly linked pair of pressure point structures being selectively positionable within a perimeter of said gel filled enclosure, pressure point structures of said single non-rigidly linked pair of pressure point structures being selectively arrangable one with respect to the other up to a pre-select not-to-exceed spacing delimited by a non-rigid linkage therebetween.

14. The therapeutic device of claim 13 wherein said pressure point structures of said single non-rigidly linked pair of pressure point structures comprise semi-rigid elements.

15. The therapeutic device of claim 13 wherein said pressure point structures of said single non-rigidly linked pair of pressure point structures have a non-linear cross-sectional portion.

16. The therapeutic device of claim 13 wherein said pressure point structures of said single non-rigidly linked pair of pressure point structures comprise spherical elements.

17. The therapeutic device of claim 13 wherein said pressure point structures of said single non-rigidly linked pair of pressure point structures comprise spherical elements having a diameter of between about 1.5 and 2.5 inches.

18. The therapeutic device of claim 13 wherein said non-rigid linkage comprises a filament.

19. The therapeutic device of claim 13 wherein said perimeter of said gel filled enclosure delimits a single volume.

20. The therapeutic device of claim 13 wherein gel of said gel filled enclosure is capable of repetitive heating/chilling in furtherance of enhancing therapeutic efficacy.

21. The therapeutic device of claim 13 wherein said pressure point structures of said single non-rigidly linked pair of pressure point structures comprise semi-rigid spherical elements.

22. The therapeutic device of claim 21 wherein said non-rigid linkage comprises a filament.

23. The therapeutic device of claim 22 wherein said perimeter of said gel filled enclosure delimits a single volume.

24. The therapeutic device of claim 23 wherein gel of said gel filled enclosure is capable of repetitive heating/chilling in furtherance of enhancing therapeutic efficacy.

25. A therapeutic device comprising a gel filled enclosure, and a single non-rigidly linked pair of pressure point structures housed therein, said single non-rigidly linked pair of pressure point structures being selectively positionable within a perimeter of said gel filled enclosure, pressure point structures of said single non-rigidly linked pair of pressure point structures being selectively arrangable one with respect to the other up to a pre-select not-to-exceed spacing delimited by a non-rigid linkage therebetween, wherein gel of said gel filled enclosure comprises a bentonite and glucose composition.

26. The therapeutic device of claim 25 wherein said pressure point structures of said single non-rigidly linked pair of pressure point structures comprise semi-rigid elements.

27. The therapeutic device of claim 25 wherein said pressure point structures of said single non-rigidly linked pair of pressure point structures have a non-linear cross-sectional portion.

28. The therapeutic device of claim 25 wherein said pressure point structures of said single non-rigidly linked pair of pressure point structures comprise spherical elements.

29. The therapeutic device of claim 25 wherein said pressure point structures of said single non-rigidly linked pair of pressure point structures comprise spherical elements having a diameter of between about 1.5 and 2.5 inches.

30. The therapeutic device of claim 25 wherein said non-rigid linkage comprises a filament.

31. The therapeutic device of claim 25 wherein said perimeter of said gel filled enclosure delimits a single volume.

32. The therapeutic device of claim 25 wherein gel of said gel filled enclosure is capable of repetitive heating/chilling in furtherance of enhancing therapeutic efficacy.

33. The therapeutic device of claim 25 wherein said pressure point structures of said single non-rigidly linked pair of pressure point structures comprise semi-rigid spherical elements.

34. The therapeutic device of claim 33 wherein said non-rigid linkage comprises a filament.

35. The therapeutic device of claim 34 wherein said perimeter of said gel filled enclosure delimits a single volume.

36. The therapeutic device of claim 35 wherein gel of said gel filled enclosure is capable of repetitive heating/chilling in furtherance of enhancing therapeutic efficacy.

37. A pressure point therapeutic device comprising an elongate enclosure, a thermally responsive composition and a pressure point structure contained therein such that said pressure point structure is freely positionable within said thermally responsive composition and in relation to said elongate enclosure, said pressure point structure comprising a first pressure point stimulator and a second pressure point stimulator, said first and second pressure point stimulators being unsupported and non-rigidly linked via a cord, said elongate enclosure having ends adapted for cooperative engagement with each other in furtherance of securing the device so as to overlay a pressure point.

38. The therapeutic device of claim 37 wherein said thermally responsive composition comprises a gel.

39. The therapeutic device of claim 37 wherein said thermally responsive composition comprises a fluid.

40. The therapeutic device of claim 37 wherein a non-rigid linkage assures a not-to-exceed spacing for and between said first pressure point stimulator and said second pressure point stimulator.

* * * * *